US010087656B1

(12) United States Patent
Cannella

(10) Patent No.: US 10,087,656 B1
(45) Date of Patent: Oct. 2, 2018

(54) KEYLESS LOCKING SYSTEM

(71) Applicant: DEE CEE MARKETING, INC., Saint Petersburg, FL (US)

(72) Inventor: Thomas B. Cannella, Clearwater, FL (US)

(73) Assignee: DEE CEE MARKETING, INC., St. Petersburg, FL (US)

( * ) Notice: Subject to any disclaimer, the term of this patent is extended or adjusted under 35 U.S.C. 154(b) by 0 days.

(21) Appl. No.: 15/597,697

(22) Filed: May 17, 2017

(51) Int. Cl.
*E05B 47/00* (2006.01)
*E05B 63/00* (2006.01)

(52) U.S. Cl.
CPC ..... *E05B 47/0012* (2013.01); *E05B 63/0004* (2013.01); *E05B 2047/002* (2013.01); *E05B 2047/0091* (2013.01)

(58) Field of Classification Search
CPC ..... E05B 47/0012; E05B 63/0004; E05B 2047/0091; E05B 2047/002; E05B 2047/0005; E05B 2047/0017; E05B 47/0038; E05B 47/02; E05B 2047/0095; E05B 2047/0084; E05B 47/00; E05B 63/00
USPC ..... 70/276, 408, 456 R, 278.1, 278.3, 256, 70/257, 277, 278.7, 279.1, 280–282; 292/141, 142, 144, 251.5
See application file for complete search history.

(56) References Cited

U.S. PATENT DOCUMENTS 2,879,725 A * 3/1959 Zuver ..... E05B 65/0075 109/39
3,600,025 A * 8/1971 Brainard ..... E05C 19/165 292/251.5
3,875,772 A * 4/1975 Ebersman ..... E05L 353/003 292/38
4,438,962 A * 3/1984 Soloviff ..... E05B 47/0012 292/144
4,557,124 A * 12/1985 Russ ..... H01M 2/1055 70/456 R
4,821,652 A * 4/1989 Hoffman ..... E05G 1/00 109/23
5,678,436 A * 10/1997 Alexander ..... E05B 47/0012 70/256
5,997,054 A * 12/1999 Baudu ..... F02K 1/76 292/201
6,216,502 B1 * 4/2001 Cannella ..... E05B 47/0012 292/142
6,591,643 B1 * 7/2003 Cannella ..... E05B 47/0012 292/142
7,373,795 B2 * 5/2008 Kilbourne ..... E05B 47/0012 292/244

(Continued)

*Primary Examiner* — Lloyd A Gall
(74) *Attorney, Agent, or Firm* — Lewellyn Law, PLLC; Stephen Lewellyn

(57) ABSTRACT

A housing has a front plate and a rear plate and a periphery there between thereby forming a chamber. A plurality of magnets removably couple the housing to a door. The door has an exterior surface with a rotatable existing deadbolt. A drive train sub-assembly with a motor is within the chamber. A power transfer sub-assembly is also within the chamber. The power transfer sub-assembly includes an elastomeric component and a C-channel positionable over the existing deadbolt. The power transfer sub-assembly is powered by the drive train sub-assembly. A control member is adapted to be pressed to power the motor to rotate the C-channel and the existing deadbolt.

3 Claims, 5 Drawing Sheets

(56) References Cited

U.S. PATENT DOCUMENTS

| | | | | |
|---|---|---|---|---|
| 9,133,651 | B2 * | 9/2015 | Trinh | E05B 65/44 |
| 9,267,583 | B2 * | 2/2016 | Narovlansky | E05B 47/0012 |
| 9,476,232 | B1 * | 10/2016 | Verdecia | E05B 19/00 |
| 2008/0296912 | A1 * | 12/2008 | Whitner | E05B 47/0012 292/144 |
| 2014/0260447 | A1 * | 9/2014 | Schmidt-Lackner | E05L 347/068 70/262 |
| 2017/0002586 | A1 * | 1/2017 | Lee | E05B 47/0012 |

* cited by examiner

FIG. 6
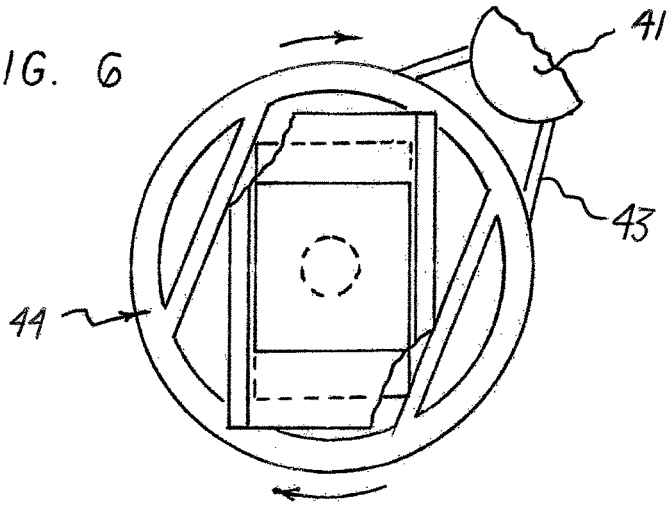
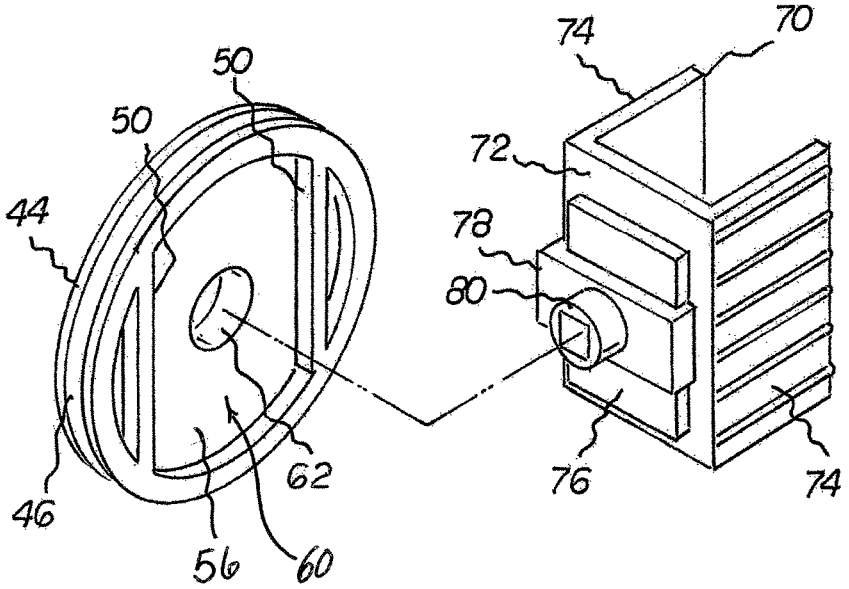
FIG. 7

KEYLESS LOCKING SYSTEM

BACKGROUND OF THE INVENTION

Related Application

The present application is an improvement over prior application Ser. No. 09/542,298 filed Apr. 4, 2000 and issued Apr. 17, 2001 as U.S. Pat. No. 6,216,502, the subject matter of which is incorporated herein by reference.

Field of the Invention

The present invention relates to a keyless locking system and more particularly pertains to confidently locking and unlocking an existing deadbolt of a door from a remote location.

DESCRIPTION OF THE PRIOR ART

The use of locking systems of known designs and configurations is known in the prior art. More specifically, locking systems of known designs and configurations previously devised and utilized for the purpose of locking and unlocking doors through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,829,138 to Morita discloses a remotely controlled latch system for fire doors and the like. U.S. Pat. No. 4,593,543 to Stefanek discloses a security lock. U.S. Pat. No. 5,896,769 to Elpern et al. discloses an electrically operated actuator. U.S. Pat. No. 5,979,199 to Elpern et al. discloses an electrically operated actuator. Lastly, U.S. Pat. No. 5,987,818 to Dabideen discloses a remotely controlled door locking and opening system.

While these devices fulfill their respective, particular objectives and requirements, the aforementioned patents do not describe a keyless locking system that allows confidently locking and unlocking an existing deadbolt of a door from a remote location.

In this respect, the keyless locking system according to the present invention substantially departs from the conventional concepts and designs of the prior art, and in doing so provides an apparatus primarily developed for the purpose of confidently locking and unlocking an existing deadbolt of a door from a remote location.

Therefore, it can be appreciated that there exists a continuing need for a new and improved keyless locking system which can be used for confidently locking and unlocking an existing deadbolt of a door from a remote location. In this regard, the present invention substantially fulfills this need.

SUMMARY OF THE INVENTION

In view of the disadvantages inherent in the known types of locks now present in the prior art, the present invention provides an improved keyless locking system. As such, the general purpose of the present invention, which will be described subsequently in greater detail, is to provide a new and improved keyless locking system and method which has all the advantages of the prior art and none of the disadvantages.

To attain this, from a broad perspective, the present invention essentially comprises a keyless locking system. Such system includes a housing having a front plate and a rear plate and a periphery there between thereby forming a chamber. A plurality of magnets removably couple the housing to a door. The door has an exterior surface with a rotatable existing deadbolt. A drive train sub-assembly with a motor is within the chamber. A power transfer sub-assembly is also within the chamber. The power transfer subassembly includes an elastomeric component and a C-channel positionable over the existing deadbolt. The power transfer sub-assembly is powered by the drive train sub-assembly. A control member is adapted to power the motor to rotate the C-channel and the existing deadbolt.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved keyless locking system which has all of the advantages of the prior art locks and none of the disadvantages.

It is another object of the present invention to provide a new and improved keyless locking system which may be easily and efficiently manufactured and marketed.

An even further object of the present invention is to provide a new and improved keyless locking system which is susceptible of a low cost of manufacture with regard to both materials and labor, and which accordingly is then susceptible of low prices of sale to the consuming public, thereby making such keyless locking system economically available to the buying public.

Lastly, it is an object of the present invention to provide a keyless locking system for conveniently locking and unlocking an existing deadbolt on an interior surface of a door.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a rear elevational view of the interface between the drive train sub-assembly and the power transfer sub-assembly.

FIG. 7 is an exploded perspective illustration of the interface between the drive train sub-assembly and the power transfer sub-assembly.

The same reference numerals refer to the same parts throughout the various Figures of the primary and alternate embodiment.

DESCRIPTION OF THE PREFERRED EMBODIMENT

Figure 1:
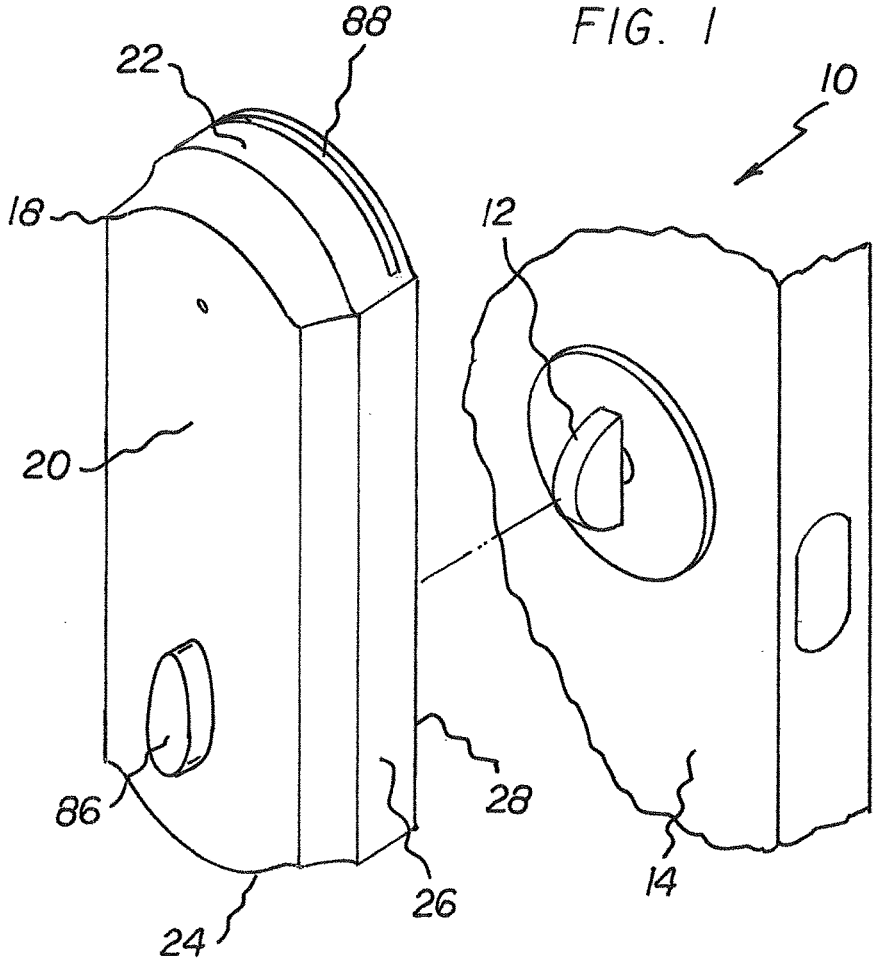
FIG. 1 is an exploded perspective illustration of a keyless locking system constructed in accordance with the principles of the present invention.
Figure 1:
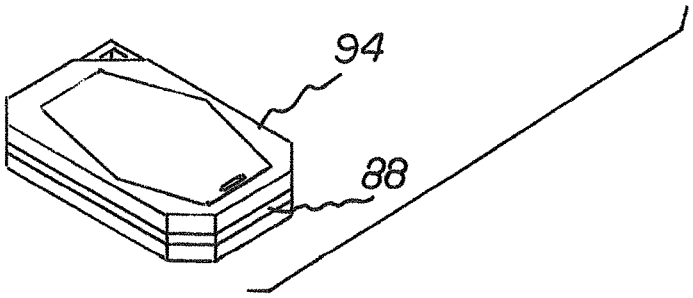
Figure 2:
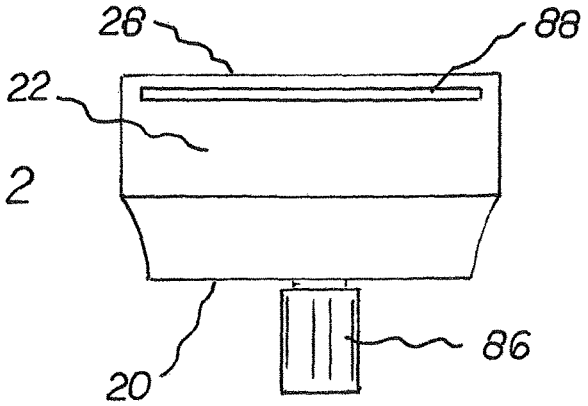
FIG. 2 is a plan view of the system shown in FIG. 1.
Figure 3:
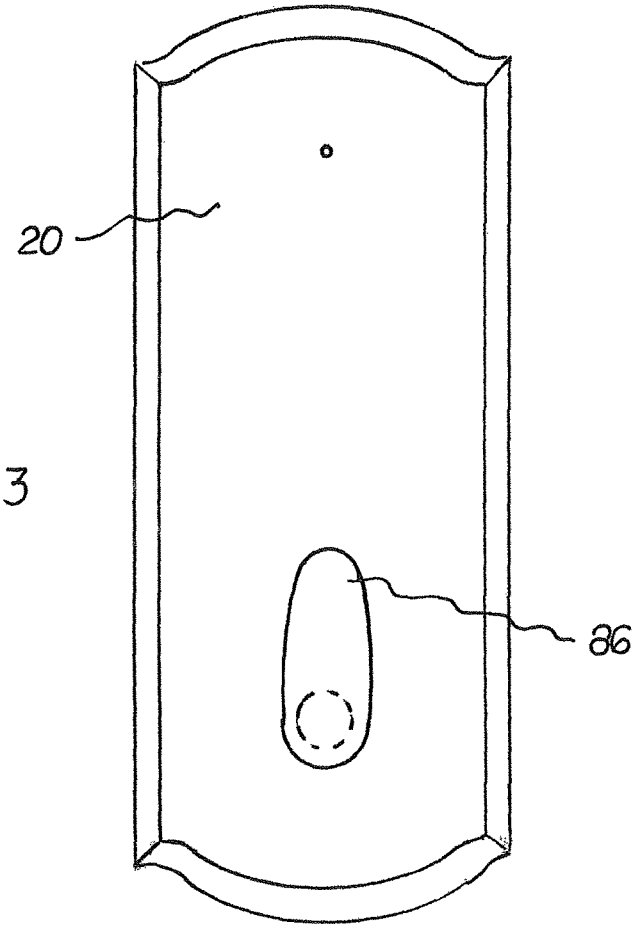
FIG. 3 is a front elevational view of the system shown in FIGS. 1 and 2.
Figure 4:
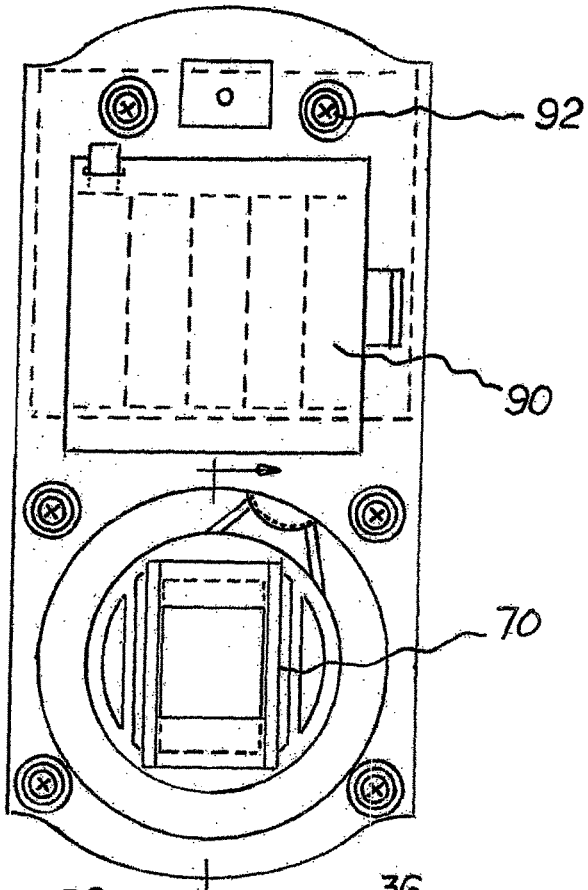
FIG. 4 is a rear elevational view of the housing shown in the prior Figures.
Figure 5:
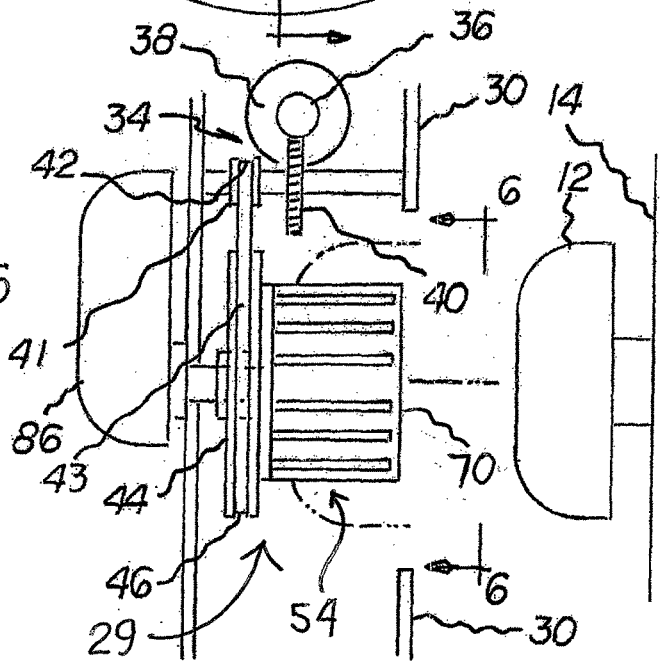
FIG. 5 is a side elevational view of the housing shown in the prior Figures.
Figure 8:
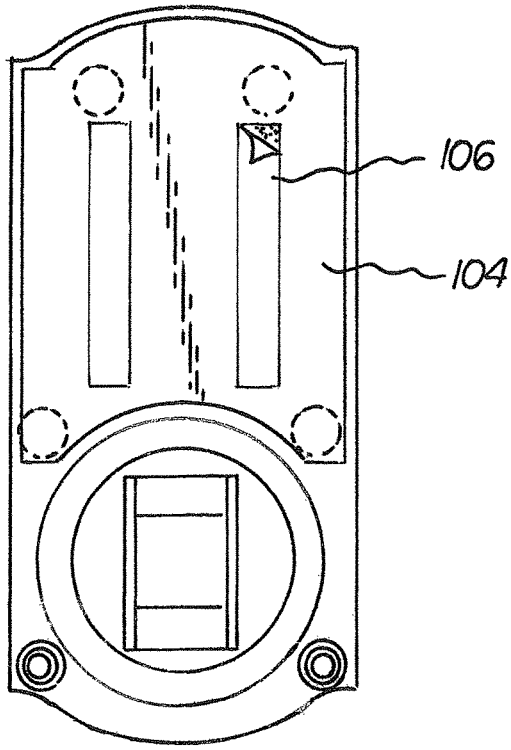
FIG. 8 is a rear elevational view similar to FIG. 4 but illustrating an alternate embodiment of the present invention, such alternate embodiment being for use with non-metal doors.
Figure 9:
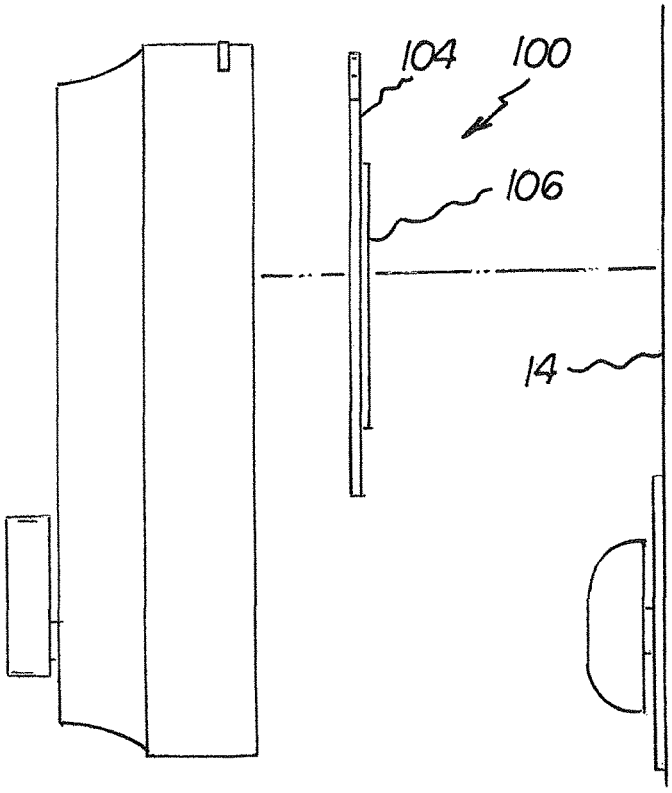
FIG. 9 is an exploded side elevational view of the alternate embodiment of FIG. 8.

With reference now to the drawings, and in particular to FIG. 1 thereof, the preferred embodiment of the new and improved keyless locking system embodying the principles and concepts of the present invention and generally designated by the reference numeral 10 will be described.

The present invention, the keyless locking system is comprised of a plurality of components. Such components in their broadest context include a housing, a drive train sub-assembly with a motor, a power transfer sub-assembly with an elastomeric component and a C-channel, and a control member to power the motor. Such components are individually configured and correlated with respect to each other so as to attain the desired objectives.

From a specific perspective, the invention of the present application is a keyless locking system 10 for conveniently locking and unlocking an existing deadbolt 12 on an interior surface 14 of a door. The locking and unlocking are from a remote location without modifying the existing deadbolt. The system includes a housing 18 in a generally rectilinear configuration having a planar plate constituting a front wall 20 with an upper edge 22, a lower edge 24, and parallel side edges 26 there between. A peripheral edge 28 extends inwardly from the upper edge 22, lower edge 24, and side edges 26. A rear wall 30 parallel with the front wall 20 is coupled to the peripheral edge 28 forming a chamber 29 there between.

A drive train sub-assembly 34 is within the chamber 29. The drive train sub-assembly 34 has a drive motor 36 with a worm gear 38 rotatable about a horizontal first axis. An intermediate gear 40 is driven by the worm gear 38 about a horizontal second axis perpendicular to and horizontally beneath the horizontal first axis. An upper pulley 41 is rotatable with the intermediate gear. The upper pulley 41 has a peripheral groove 42 with a first diameter. A lower pulley 44 is rotatable about a third axis beneath and parallel with the second axis. The lower pulley 44 has a peripheral groove 46 with a second diameter greater than the first diameter. A belt 43 couples the groove 42 and the groove 46 of the upper pulley 41 and the lower pulley 44, respectively.

A power transfer sub-assembly 54 is within the chamber 29. The power transfer sub-assembly 54 includes a recess 56 in the lower pulley 44. Parallel drive arms 50 are laterally spaced within the recess defining a drive chamber 60 between the drive arms. A central aperture 62 is in the drive chamber 60.

The power transfer sub-assembly 54 also includes a C-channel 70 with a central plate 72 and two parallel side plates 74 extending inwardly. The side plates 74 are located to receive the existing deadbolt for locking and unlocking the door. The central plate 72 has an actuator 76 fabricated of an elastomer in a rectangular configuration facing outwardly. A bracket 78 covers a central region of the actuator 76 and attaches the actuator to the central plate 72. The bracket 78 has a sleeve 80 extending outwardly through the central aperture 62 to position the actuator 76 between the drive arms 50 whereby oscillation of the lower pulley 44 and the drive arms 50 will oscillate the C-channel 70 and the existing deadbolt.

A control member 94 is adapted to be in the possession of the user. The control member, in the preferred embodiment, is a proximity sensor adapted to initiate powering of the motor when coming within a fixed distance from the housing. Any of a wide variety of electronic devices may be used as an alternate to the control member.

A supplemental knob 86 extends outwardly of the housing and operatively couples to the C-channel to lock and unlock the existing deadbolt independent of the motor.

Antennas 88 on the control member and on the housing function to facilitate the remote operation of the system.

A plurality of batteries 90 are in the chamber to power the motor.

A plurality of magnets 92 are on the rear face of the housing to removably couple the housing to the interior surface of the door.

Lastly provided is an optional assembly 100 for use with non-metal doors. The optional assembly includes a metal plate 104 with adhesive strips 106 securable to the non-metal door. This provides a recipient surface for removably receiving the magnets of the housing.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A keyless locking system comprising:

a housing having a front wall and a rear wall forming a chamber there between;

a plurality of magnets removably coupling the housing to a door, the door having an exterior surface with a rotatable existing deadbolt;

a drive train sub-assembly within the chamber, the drive train sub-assembly having a motor;

a power transfer sub-assembly within the chamber, the power transfer sub-assembly including an actuator formed of an elastomeric component and a C-channel positionable over the existing deadbolt, the power transfer sub-assembly being powered by the drive train sub-assembly;

a control member adapted to power the motor to rotate the C-channel and the existing deadbolt;

the power transfer sub-assembly including a recess in a pulley of the drive train sub-assembly, parallel drive arms laterally spaced within the recess defining a drive chamber between the drive arms, a central aperture in the drive chamber; and wherein the C-channel includes a central plate and two parallel side plates extending inwardly, the side plates being located to receive the existing deadbolt for locking and unlocking the door, the central plate having the actuator in a rectangular configuration facing outwardly, a bracket covering a central region of the actuator and attaching the actuator to the central plate, the bracket having a sleeve extending outwardly through the central aperture to position the actuator between the drive arms whereby oscillation of the pulley and the drive arms will oscillate the C-channel and the existing deadbolt.

2. A keyless locking system comprising:

a housing having a front wall and a rear wall forming a chamber there between;

a plurality of magnets removably coupling the housing to a door, the door having an exterior surface with a rotatable existing deadbolt;

a drive train sub-assembly within the chamber, the drive train sub-assembly including a motor;

a power transfer sub-assembly with the chamber, the power transfer sub-assembly including an elastomeric component and a C-channel positionable over the existing deadbolt, the power transfer sub-assembly being powered by the drive train sub-assembly;

a control member adapted to power the motor to rotate the C-channel and the existing deadbolt; and the drive train sub-assembly including a worm gear operably connected to the motor and rotatable about a horizontal first axis, an intermediate gear driven by the worm gear about a horizontal second axis perpendicular to and horizontally beneath the horizontal first axis, a first pulley rotatable with the intermediate gear and having a peripheral groove with a first diameter, a second pulley rotatable about a third axis beneath and parallel with the second axis, the second pulley having a peripheral groove with a second diameter greater than the first diameter, a belt coupling the grooves of the first and second pulleys.

3. A keyless locking system for conveniently locking and unlocking an existing deadbolt on an interior surface of a door, the locking and unlocking being from a remote location without modifying the existing deadbolt, the system comprising:

a housing being in a generally rectilinear configuration having a planar plate constituting a front wall within an upper edge, a lower edge, and parallel side edges, a rear wall parallel with the front wall forming a chamber between the front wall and the rear wall;

a drive train sub-assembly within the chamber, the drive train sub-assembly having a motor, a worm gear operatively connected to the motor and rotatable about a horizontal first axis, an intermediate gear driven by the worm gear about a horizontal second axis perpendicular to and horizontally beneath the horizontal first axis, a first pulley rotatable with the intermediate gear and having a peripheral groove with a first diameter, a second pulley rotatable about a third axis beneath and parallel with the second axis, the second pulley having a peripheral groove with a second diameter greater than the first diameter, a belt coupling the grooves of the first and second pulleys;

a power transfer sub-assembly within the chamber, the power transfer sub-assembly including a recess in the second pulley, parallel drive arms laterally spaced within the recess defining a drive chamber between the drive arms, and a central aperture in the drive chamber;

the power transfer sub-assembly also including a C-channel with a central plate and two parallel side plates extending inwardly, the side plates being located to receive the existing deadbolt for locking and unlocking the door, the central plate having an actuator fabricated of an elastomer in a rectangular configuration facing outwardly, a bracket covering a central region of the actuator and attaching the actuator to the central plate, the bracket having a sleeve extending outwardly through the central aperture to position the actuator between the drive arms whereby oscillation of the second pulley and the drive arms will oscillate the C-channel and the existing deadbolt;

a control member adapted to drive the motor a predetermined number of revolutions to rotate the existing deadbolt for locking and unlocking the door;

a supplemental knob extending forward of the housing and operatively coupled to the C-channel to lock and unlock the existing deadbolt independent of the motor;

antennas on the control member and on the housing to facilitate the remote operation of the system;

batteries located within the chamber to power the motor;

a plurality of magnets on the housing to removably couple the housing to the interior surface of the door; and an assembly for use with non-metal doors, the assembly including a metal plate with adhesive strips securable to the non-metal door to provide a recipient surface for removably receiving the magnets.

* * * * *